United States Patent [19]

Foster et al.

[11] Patent Number: 4,722,293

[45] Date of Patent: Feb. 2, 1988

[54] INTEGRATED WINCH AND WINDLASS

[75] Inventors: Derek Foster, Brampton; Ronald Ballantyne, Burlington, both of Canada

[73] Assignee: John T. Hepburn, Limited, Mississauga, Canada

[21] Appl. No.: 791,151

[22] Filed: Oct. 24, 1985

[51] Int. Cl.[4] ..... B63B 21/50

[52] U.S. Cl. ..... 114/230; 114/293; 254/372; 254/285

[58] Field of Search ..... 114/144 B, 179, 180, 114/181, 199, 200, 210, 230, 264, 293; 242/55 BW; 254/288, 372, 284, 285, 286, 290, 291, 292, 293

[56] References Cited

U.S. PATENT DOCUMENTS

| | | | |
|---|---|---|---|
| 3,842,776 | 10/1974 | Wudtke | 114/230 |
| 3,912,228 | 10/1975 | Petty et al. | 114/230 |
| 4,020,779 | 5/1977 | Kitt | 114/293 |
| 4,170,186 | 10/1979 | Shaw | 114/293 |
| 4,476,801 | 10/1984 | Foster et al. | 114/293 |

FOREIGN PATENT DOCUMENTS

| | | | |
|---|---|---|---|
| 880867 | 11/1981 | U.S.S.R. | 114/293 |

*Primary Examiner*—Joseph F. Peters, Jr.

*Assistant Examiner*—Stephen P. Avila

[57] ABSTRACT

An integrated winch and windlass for hauling in and paying out a mooring line which consists of wire rope serially connected to chain cable is described. The integrated system has a pair of traction winch drums for conveying the wire rope, and a chain wheel for conveying the chain cable. The chain wheel is coaxially mounted with one traction winch drum, and has a wire rope groove with a groove diameter substantially the same as that of the traction winch drums. A sheave directs wire rope between one of the drums and the chain wheel, and is so positioned that a wrap of wire rope is formed about the chain wheel whenever the system is operating on wire rope exclusively. A drive mechanism is provided for rotating the traction winch drums and chain wheel, including a common drive shaft, and a clutch mechanism which permits the traction winch drums and the chain wheel to be located simultaneously or separately. Simultaneous rotation of the chain wheel and traction winch drums is timed so that wire rope is conveyed at the same speed by the traction winch drums and the chain wheel. The chain wheel is effectively integrated into the traction winch functions, the wire rope groove of the chain wheel basically serving as the first groove of a traction winch.

8 Claims, 3 Drawing Figures

INTEGRATED WINCH AND WINDLASS

FIELD OF THE INVENTION

The invention relates generally to mooring systems, and more specifically, to the construction of winch and windlass systems for handling composite mooring lines combining wire rope and chain cable, which are commonly used in mooring ocean-going vessels and offshore drilling platforms.

BACKGROUND OF THE INVENTION

Over at least the last 10 years, considerable attention has been directed to mooring systems employing composite mooring lines. This has been due largely, though not exclusively, to growing use of offshore drill platforms which must often be moored in very deep water during oil exploration. The advantages of employing a composite mooring line consisting of a lower length of chain cable serially connected to an upper length of wire rope are well recognized. In particular better anchoring characteristics at certain water depths can be achieved than is possible through use of wire rope or chain alone. An overall capability to moor in deeper water is obtained. However, use of a composite mooring line introduces new problems, including problems of conveying a chain cable-wire rope connector over fairlead sheaves and the like, and both increased demand on deck space and greater system weight because of the requirement for both winches and windlasses to handle the composite mooring line.

First mooring systems adapted to handle composite mooring lines involved a breaking and re-making of the chain cable-wire rope connection during hauling in and paying out. Basically, the components of the mooring line were separated, depending on whether chain cable was to be conveyed by a windlass or wire rope by a winch. In particular, U.S. Pat. No. 3,842,776 issued to Wudtke on Oct. 22, 1974 introduced a particular disconnect system which included a special wire rope-chain cable connector carried by an outermost groove of the system fairlead sheave during transition from wire rope to chain cable avoiding undue bending of the wire rope during such transition.

An alternative non-disconnect system was proposed in U.S. Pat. No. 3,912,228 which issued to Petty et al on Oct. 14, 1975. That mooring system involves a windlass and drum winch, and a sheave positioned in the interior of an associated chain locker a sufficient distance below the winch that acceptable fleet angles are maintained, and in an orientation which permits the chain to be deposited inside the chain locker without disengaging the mooring line from the interior sheave. During hauling in, for example, the wire rope can be hauled in by the winch until links of chain cable deposit in pockets of the chain wheel, and the chain wheel then actuated to deposit the chain cable into a locker positioned below the chain wheel.

In U.S. Pat. No. 4,476,801 issued on Oct. 16, 1984 to Foster and Rich, there is described a more recently developed non-disconnect system in which a traction winch is mounted vertically over a windlass to achieve a common line of action for both chain and wire rope. A retractor is provided to draw chain from the vertical line of action over the chain wheel to engage the chain links with the whelps of the chain wheel so that the chain may be deposited into a chain locker. Advantageously, such a system eliminates the problem of conveying a wire rope-chain cable connector over the windlass chain wheel.

Such mooring systems have obviated the disconnection problem; however, they still involve a separate winch and windlass, each designed, together with associated brake mechanisms, to handle individually the maximum loads expected on the mooring line.

Accordingly, it is an object of the present invention to more fully integrate the winch and windlass functions of a mooring system adapted to handle a composite mooring line.

BRIEF SUMMARY OF THE INVENTION

In general terms, the invention provides a winch and windlass system for handling composite mooring line in which a chain wheel functions as part of an associated traction winch. The term "chain wheel" as used in this disclosure and the appended claims is intended to include chain wheels commonly referred to in North America as "wildcats" and those referred to in Europe as "gypsies". Basically, in the mooring system of the invention, the chain wheel is provided with a wire rope groove which is arranged to function essentially as a first groove of the traction winch, bearing much of the forces otherwise imposed on a conventional traction winch in mooring applications. Such an arrangement reduces the load requirements placed on the various components of the traction winch, including its braking system.

More specifically, the invention provides an integrated winch and windlass for hauling in and paying out a mooring line composed of wire rope serially connected to chain cable. A chain wheel is provided for conveying the chain cable, and has a wire rope groove in which the wire rope can be conveyed. A pair of traction winch drums are also provided for conveyance of the wire rope, including a "lead drum" intended to receive and deliver wire rope from and to the chain wheel. Sheave means direct the wire rope along a preselected wire rope path between the lead drum and the chain cable, the wire rope path being so selected that a partial wrap of wire rope is formed in the wire rope groove of the chain wheel whenever wire rope is being conveyed along the preselected wire rope path. Drive means are provided for rotating the traction winch drums and the chain wheel to convey the mooring line. The drive means are adapted to selectively rotate the traction winch drums and the chain wheel either simultaneously or separately, and include timing means which regulate the relative rates of rotation of the traction winch drums and the chain wheel, when these components are simultaneously rotated to convey wire rope, so that the wire rope is conveyed at essentially the same speed by both the traction winch drums and the chain wheel. The operation of the chain wheel is thus more fully integrated into the functioning of the traction winch drums.

DESCRIPTION OF THE DRAWINGS

The invention will be better understood with reference to drawings illustrating a preferred embodiment, in which.

DESCRIPTION OF PREFERRED EMBODIMENT

Figure 1:
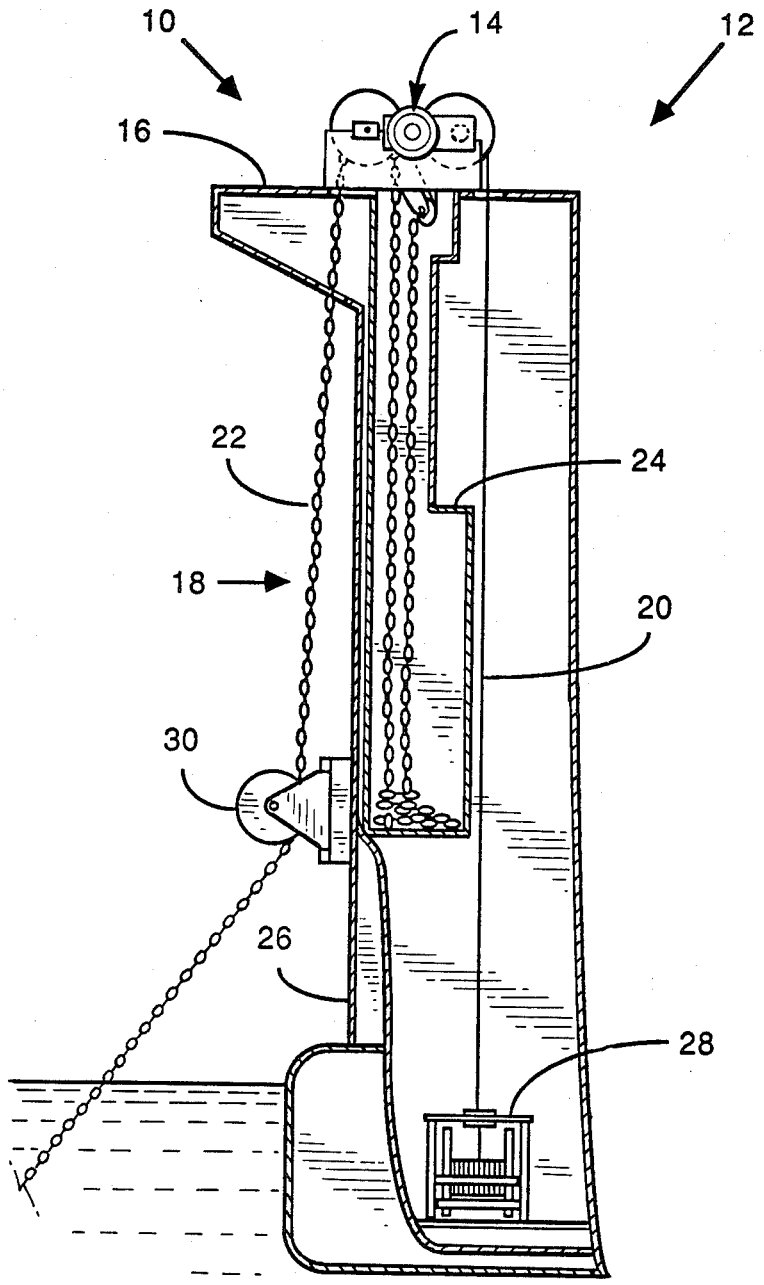
FIG. 1 is a fragmented side elevational view illustrating an integrated winch and windlass mooring system mounted on a drill platform.

Reference is made to FIG. 1 which illustrates a mooring system generally indicated by the reference numeral 10 mounted on a semi-submersible drill rig 12 (extensively fragmented). The mooring system includes an integrated winch and windlass unit 14 which is mounted on a deck 16 of the drill rig 12, and which serves to haul in and pay out a composite mooring line 18 including wire rope 20 serially connected to chain cable 22, the chain cable 22 being terminated with an appropriate anchoring device (not illustrated). The integrated winch and windlass unit 14 is positioned immediately above a chain locker 24 formed in a hollow rig leg 26, so that the chain cable 22 may be conveniently deposited into the chain locker 24 when hauled in. The wire rope 20 is received from the integrated winch and windlass unit 14 and stored by a conventional storage winch 28, conveniently located in a compartment at the bottom of the rig leg 26. The system 10 also includes a fairlead sheave 30 mounted on the exterior of the rig leg 26 basically to direct the mooring line 18 to and from the drill rig 12 and to the integrated winch and windlass unit 14. The overall arrangement of the mooring system 10 is conventional, and consequently will not be described in greater detail.

Figure 2:
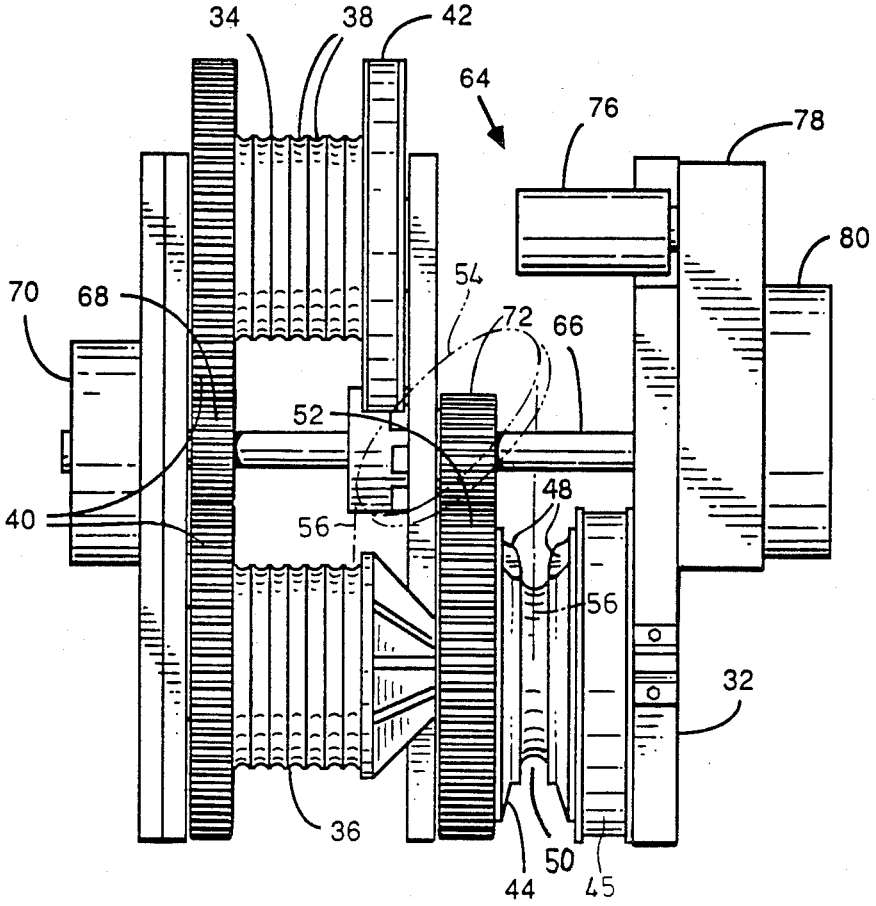
FIG. 2 is a plan view of the integrated winch and windlass.
Figure 3:
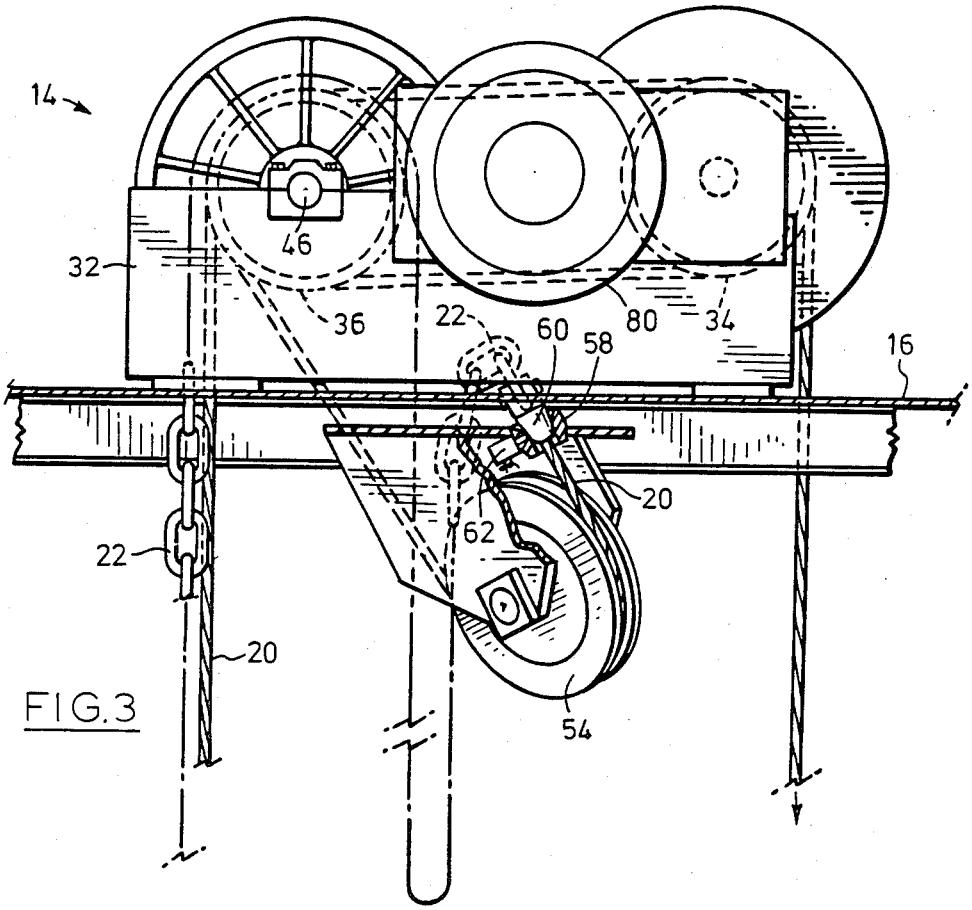
FIG. 3 is a side elevational view illustrating the integrated winch and windlass together with an associated sheave which serves to transfer wire rope between the two components.

The integrated winch and windlass unit 14 are illustrated in greater detail in the view of FIGS. 2 and 3. The integrated unit 14 has a support frame 32 generally of conventional steel plate construction which maintains various components of the integrated unit 14 in operative relationship. These components include a pair of traction winch drums, including a lead drum 34, and a trailing drum 36 which delivers and receives wire rope to and from the storage winch 28. The lead drum 34, which is typical of the two drums, has multiple grooves, only one groove 38 being specifically indicated. The grooves have a predetermined groove diameter, selected according to well-known principles, to be at least fifteen times the diameter of the wire rope 14 to avoid excessive rope bending. The lead and trailing drums are of course positioned to function as "traction winch drums" in a parallel and spaced-apart relationship in which wraps of wire rope can be maintained between the two drums. The drums carry conventional bull gears 40 by means of which the drums can be rotated, and a conventional band brake 42 is provided to stop rotation of the drums against expected line loads.

The integrated unit 14 also includes a chain wheel 44. The chain wheel 44 is mounted on a common axle 46 with the trailing drum 36, each being bearing mounted on the common axle 46 for rotation about the common axle 46. The chain wheel 44 has whelps (only one pair 48 specifically indicated in FIG. 2) for conveying chain cable, and also has a wire rope groove 50 for conveying wire rope. The wire rope groove 50 has the same diameter as the grooves of the traction winch drums, which is critical for the operation of this particular embodiment of the invention, but not generally essential to the invention, as will be explained more fully below. The chain wheel 44 carries a bull gear 52 by means of which the chain wheel 44 can be rotated to convey chain cable, and also wire rope under power. It should be noted that the term "conveying" as used in this specification in respect to sheaves, drums and chain wheels, is intended to denote transfer of a mooring line generally about a circumferential periperal surface of the particular device in either circumferential direction.

Wire rope is transferred between the lead drum 34 and the chain wheel 44 over a sheave 54. The sheave 54 is positioned below and between the lead drum 34 and the chain wheel 44, and rotatably mounted to the deck 16. Alternatively, the sheave 54 can be mounted directly on the support frame 32, if convenient for a particular application, in which case the support frame 32 alone functions as all means necessary for maintaining the components of the integrated unit 14 in operative relationship. The sheave 54 is positioned to direct the wire rope along a preselected path 56 (shown in stippled outline in FIG. 3) which ensures that a partial wrap of wire rope is contained in the chain wheel 44 wire rope groove 50 whenever the integrated unit 14 is operating on wire rope, basically as a traction winch. The advantages of this arrangement will be discussed more fully below.

An apertured, plate-shaped socket arrestor 58 is suspended from the dock 16 adjacent and spaced slightly above the bottom of the sheave 54. As illustrated in FIG. 3, in which the wire rope has been completely hauled in, a conical, socketted connector 60 which joins the wire rope 20 to the chain cable 22 lodges in the aperture of the socket arrestor 58. A mechanical trip switch 62 is then actuated by engagement with the connector 60 to discontinue rotation of the traction winch drums and chain wheel 44. Provision of the trip switch 62 is preferred, but an operator at the controls normally associated with such a mooring system will normally have instruments which will indicate engagement of the connector 60 with the socket arrestor 58, and can then discontinue hauling in of the wire rope.

The integrated unit 14 has a drive 64 common to both the traction winch drums and the chain wheel 44. The drive 64 includes a drive shaft 66 rotatably mounted on the support frame 32 parallel to the axles which support the traction winch drums and the chain wheel 44. A pinion gear 68 is meshed with the traction winch bull gears 40, and a traction winch clutch 70 serves to selectively engage and disengage the pinion gear 68 with the drive shaft 66 thereby clutching and de-clutching the traction winch drums from the drive shaft 66. A pinion gear 72 is meshed with the chain wheel 44 bull gear, and a chain wheel clutch 74 serves to selectively engage and disengage the pinion gear 72 from the drive shaft 66 therby clutching and de-clutching the chain wheel 44 from the drive shaft 66. The drive 64 includes an electric motor 76 and a reduction gear box 78 through which the electric motor 76 rotates the drive shaft 66. Conventional controls are provided to permit an operator to selectively actuate the electric motor 76 and also the clutches 70,74. Accordingly, the drive 64 can be selectively actuated to rotate the traction winch drums and the chain wheel 44 either simultaneously or separately.

The chain wheel 44 is timed to rotate at the same speed as the traction winch drums, particularly the lead drum 34. This is important when the unit 14 is operating on wire rope, as a partial wrap of wire rope is in such circumstances formed in the wire rope groove 50 of the chain wheel 44, which is powered rather than free wheeling, and disparate rates of rotation would result in stressing of the wire rope. Basically, the gear ratio between the pinion gear 72 and the chain wheel bull gear 52 is the same as the gear ratio between the pinion gear 68 and the traction drum bull gears 40. This arrangement is suitable when the chain wheel 44 and the traction winch drums have the same wire rope groove diameters. However, the wire rope grooves need not be constrained by such a relationship, if the two gear ratios referred to above are appropriately selected to ensure that wire rope is conveyed at the same speed by both the traction winch drums and the chain wheel 44, whenever the integrated unit 14 is operating on wire rope.

Hauling in of the mooring line 18 will now be discussed, assuming that initially the mooring line 18 has been completely payed out. The drive 64 is actuated to rotate both the traction winch drums and the chain wheel 44, both sets of components functioning to haul in the wire rope simultaneously as a single traction winch unit. The wire rope is hauled in until chain cable begins to engage the chain wheel 44. The brakes of the chain wheel 44 and traction winch drums are then engaged, the drive 64 is de-activated, and the chain wheel 44 is de-clutched from the drive shaft 66. The drive 64 is then actuated to rotate only the traction winch drums, and the various brakes are released to permit rotation of the traction winch drums with the chain wheel 44 free wheeling. The remaining length of rope is then hauled in solely by the traction winch drums until the connector 60 seats in the socket arrestor 58. The chain links will at that point have seated in the whelps of the chain wheel 44, and chain cable movement will be synchronized with rotation of the chain wheel 44. The brakes of the chain wheel 44 and the traction winch drums are then engaged to hold the mooring line 18, the drive 64, de-activated, and the traction winch drums, de-clutched from the drive shaft 66. The chain wheel clutch 74 is then actuated to permit rotation of the chain wheel 44 by the drive shaft 66, the drive 64 actuated, and the chain wheel 44 brakes released to permit hauling in of the chain cable, which is deposited under gravity into the chain locker 24.

At the point at which the chain cable is about to engage the chain wheel 44, during hauling in, it may be necessary to hang off the chian and to position the chain wheel 44 relative to the connector 60 for proper synchronization of the connector 60 with the whelps of the chain wheel 44. This may be done by de-clutching the traction winch drums from the drive shaft 66 until the chain wheel 44 is rotated by the drive 64 to the desired position.

The process of paying out the mooring line 18 is essentially the reverse of the hauling in process, with minor exceptions. The chain wheel brakes are released, the chain wheel 44 alone is clutched to the drive shaft 66, and the drive 64 is actuated to rotate the chain wheel 44 in a direction which causes a paying out of the chain cable. Braking during paying out is controlled by a dynamic brake 80 fixed to the support frame 32 and releasably engaging the drive shaft 66. When the chain cable has been removed from the chain locker 24, the chain wheel brakes are engaged, the drive 64 is de-activated, and the chain wheel de-clutched from the drive shaft 66. The traction winch drums are then clutched to the drive shaft 66, the drive shaft 66 is actuated to rotate the traction winch drums to effect a paying out of the wire rope (from the storage winch 28), and the various brakes released to allow paying out of the mooring line 18, with the chain wheel 44 basically free wheeling. Once the wire rope has been payed out to the extent desired both the chain wheel and traction-drum brakes are re-engaged to hold the mooring line 18 against static loads, and the drive 64 de-activated.

Since the chain wheel 44 acts with the traction winch drums as a single traction winch unit during hauling in and paying out of the wire rope and effectively carries the first wrap of the resultant traction winch unit a very substantial portion of line load otherwise applied to the traction winch drums is reacted into the chain wheel 44. The traction winch drums and their associated brakes can accordingly be made less robust. This significantly reduces the weight, size and cost of an overall non-disconnect mooring system.

It will be appreciated that a particular embodiment of the invention has been described and modifications may be made therein without departing from the spirit of the invention or the scope of the appended claims. In particular, it should be noted that the benefits of the invention can be obtained, perhaps to a lesser degree, in a system embodying the invention, but involving mounting of the chain wheel 44 on an axle separate from those of the traction winch drums. Also, in coaxially mounting the chain wheel 44 with one of the traction winch drums, it is not essential that the chain wheel 44 be mounted with the trailing drum 36, as opposed to the lead drum 34, so long as the drive 64 is appropriately adjusted and also the wire rope path 56 between the traction winch drums and the chain wheel 44.

We claim:

1. An integrated winch and windlass for hauling in and paying out a mooring line which includes wire rope serially connected to chain cable, comprising:

a chain wheel for conveying the chain cable when the chain wheel is rotated, the chain wheel including a wire rope groove for conveying the wire rope when the chain wheel is rotated;

a pair of traction winch drums for conveying the wire rope whenthe traction winch drums are rotated, the pair of traction winch drums including a lead drum which transfers rope to and from the chain wheel and a trailing drum;

sheave means for directing the wire rope along a preselected wire rope path between the lead drum and the wire rope groove of the chain wheel, the wire rope path being so selected that a partial wrap of the wire rope is formed in the wire rope groove of the chain wheel when the wire rope is being conveyed along the preselected wire rope path; and, drive means for rotating the traction winch drums and the chain wheel, the drive means being adapted to selectively rotate the traction winch drums and the chain wheel both simultaneously and separately, the drive means including timing means for so timing the rotation of the traction winch drums with the rotation of the chain wheel, when the traction winch drums and the chain wheels are simultaneously rotated, that the wire rope is conveyed at the same speed by both the traction winch drums and the wire rope groove of the chain wheel.

2. An integrated winch and windlass as claimed in claim 1 in which the chain wheel and one of the lead and trailing drums are coaxially and rotatably mounted on a common axle.

3. An integrated winch and windlass as claimed in claim 2 in which the drive means comprise:

a drive shaft; and, drive clutch means for selectively coupling the traction winch drums and the chain wheel to the drive shaft for rotation with the drive shaft, the clutch means including chain wheel clutch means for coupling the chain wheel to the drive shaft and traction drum clutch means for coupling the traction winch drums to the drive shaft.

4. An integrated winch and windlass as claimed in claim 1 comprising support means for supporting the traction winch drums, the chain wheel, the sheave means and the drive means in an operative relationship.

5. A mooring system for a floating vessel, comprising:

a mooring line which includes wire rope serially connected to chain cable;

a chain locker internal to the vessel for storing the chain cable;

a chain wheel for conveying the chain cable when the chain wheel is rotated, the chain wheel including a wire rope groove for conveying the wire rope when the chain wheel is rotated;

a pair of traction winch drums for conveying the wire rope when the traction winch drums are rotated, the pair of traction winch drums including a lead drum which transfers rope to and from the chain wheel and a trailing drum;

sheave means for directing the wire rope along a preselected wire rope path between the lead drum and the wire rope groove of the chain wheel, the wire rope path being so selected that a partial wrap of the wire rope is formed in the wire rope groove of the chain wheel whenthe wire rope is being conveyed along the preselected wire rope path;

drive means for rotating the traction winch drums and the chain wheel, the drive means being adapted to selectively rotate the traction winch drums and the chain wheel both simultaneously and separately, the drive means including timing means for so timing the rotation of the traction winch drums with the rotation of the chain wheel, when the traction winch drums and the chain wheel are simultaneously rotated, that the wire rope is conveyed at the same speed by both the traction winch drums and the wire rope groove of the chain wheel;

the traction winch drums, the chain wheel and the sheave means being so mounted on the vessel that, with rotation of the traction winch drums stopped, the chain wheel can be rotated by the drive means to deposit and remove all chain cable in the chain locker.

6. A mooring system as claimed in claim 5, in which the chain wheel and one of the lead and trailing drums are coaxially and rotatably mounted on a common axle.

7. A mooring system as claimed in claim 6 in which the drive means comprise:

a drive shaft; and, drive clutch means for selectively coupling the traction winch drums and the chain wheel to the drive shaft for rotation with the drive shaft, the clutch means including chain wheel clutch means for coupling the chain wheel to the drive shaft and traction drum clutch means for coupling the traction winch drums to the drive shaft.

8. An integrated winch and windlass for hauling in and paying out a mooring line which includes wire rope serially connected to chain cable, comprising:

a chain wheel for conveying the chain cable when the chain wheel is rotated, the chain wheel including a wire rope groove for conveying the wire rope when the chain wheel is rotated;

a pair of traction winch drums for conveying the wire rope when the traction winch drums are rotated;

sheave means for directing the wire rope along a preselected wire rope path between one of the pair of traction winch drums and the chain wheel, the wire rope path being so selected that a partial wrap of the wire rope is formed in the wire rope groove of the chain wheel when the wire rope is being conveyed along the preselected wire rope path; and drive means for rotating the traction winch drums and the chain wheel, the drive means being adapted to selectively rotate the traction winch drums and the chain wheel both simultaneously and separately, the drive means including timing means for so timing the rotation of the traction winch drums with the rotation of the chain wheel, when the traction winch drums and the chain wheel are simultaneously rotated, that the wire rope is conveyed at the same speed by both the traction winch drums and the wire rope groove of the chain wheel.

* * * * *